US006886282B2

(12) United States Patent
Sumner, III et al.

(10) Patent No.: US 6,886,282 B2
(45) Date of Patent: May 3, 2005

(54) DISPLAY HOLDER FOR VEHICLE INTERIOR

(76) Inventors: Robert E. Sumner, III, 3624 Country Club Dr., Gastonia, NC (US) 28056; Libby F. Morgan, 911 Lady St., Suite A, Cola, SC (US) 29201; William R. Jenkins, 3630 Country Club Dr., Gastonia, NC (US) 28056

( * ) Notice: Subject to any disclaimer, the term of this patent is extended or adjusted under 35 U.S.C. 154(b) by 33 days.

(21) Appl. No.: 10/266,269

(22) Filed: Oct. 7, 2002

(65) Prior Publication Data

US 2003/0066224 A1 Apr. 10, 2003

Related U.S. Application Data

(60) Provisional application No. 60/327,720, filed on Oct. 9, 2001.

(51) Int. Cl.[7] ..... G09F 21/04

(52) U.S. Cl. ..... 40/593; 40/611.1; 40/650

(58) Field of Search ..... 40/589, 591, 593, 40/606.12, 611.06, 611.08, 611.09, 611.1, 649, 650, 661

(56) References Cited

U.S. PATENT DOCUMENTS

| | | | | | |
|---|---|---|---|---|---|
| 1,200,229 | A | * | 10/1916 | Philips | 40/646 |
| 1,733,890 | A | * | 10/1929 | Leal | 40/646 |
| 2,198,727 | A | * | 4/1940 | Hall | 40/593 |
| 2,337,517 | A | * | 12/1943 | Wotton | 40/646 |
| 3,161,972 | A | * | 12/1964 | Newcomb et al. | 40/646 |
| 3,210,875 | A | * | 10/1965 | Schwenkler | 40/589 |
| 3,977,112 | A | * | 8/1976 | Breer, II | 40/760 |
| 4,055,012 | A | | 10/1977 | Cote | |
| 4,258,492 | A | | 3/1981 | Williams | |
| 4,837,954 | A | * | 6/1989 | Shultz | 40/792 |
| 4,940,622 | A | | 7/1990 | Leavitt et al. | |
| 4,953,315 | A | | 9/1990 | Romaine | |
| 4,955,153 | A | | 9/1990 | Albrecht et al. | |
| 5,131,177 | A | | 7/1992 | Sy | |
| 5,189,822 | A | * | 3/1993 | Schmanski et al. | 40/611.05 |
| 5,229,910 | A | | 7/1993 | Kasahara | |
| 5,502,912 | A | | 4/1996 | LeBoff et al. | |
| 5,881,481 | A | | 3/1999 | Bashaw et al. | |
| 5,933,994 | A | * | 8/1999 | Misaresh | 40/649 |
| 6,006,462 | A | | 12/1999 | Lackomar | |
| 6,125,566 | A | | 10/2000 | McLaughlin | |
| 6,163,997 | A | | 12/2000 | Deralas | |
| 6,178,677 | B1 | | 1/2001 | Williams | |

* cited by examiner

*Primary Examiner*—Andrew D. Wright
(74) *Attorney, Agent, or Firm*—Joseph T. Guy; Nexsen Pruet, LLC.

(57) ABSTRACT

A display holder for attachment to an interior of a vehicle. The display holder is capable of slidably receiving a display. The display holder comprises a rectangular window plate comprising a front edge, rear edge, first side edge and second side edge. A first mounting plate is attached to the first side edge wherein the window plate and the first mounting plate form a first elongated slot there between. A second mounting plate is attached to the second side edge wherein the window plate and the second mounting plate form a second elongated slot there between. An end cap is attached to the interior and overlays the front edge.

16 Claims, 4 Drawing Sheets

DISPLAY HOLDER FOR VEHICLE INTERIOR

RELATED APPLICATIONS

This application claims priority to provisional application No. 60/327,720 filed Oct. 9, 2001.

TECHNICAL FIELD

The present invention is directed to a display holder for attachment to a vehicle interior. More specifically, the present invention is related to a display holder which is particularly adaptable to the interior wall of a passenger bus.

BACKGROUND

Display signs are common in transportation devices such as cars, trains, busses and the like. It is of great advantage to the transportation company to offer various surfaces for advertising space. This practice converts an otherwise irrelevant surface into a source of additional revenue or a place for a message, or announcement.

Displays on flat surfaces are common and it is relatively easy to construct a frame, or display holder, for adaption to a flat surface. Curved surfaces are more difficult because the artisan must develop a display which is sufficiently secure to avoid the risk of falling from the intended location while at the same time being flexible enough to easily contour to a curved surface.

U.S. Pat. No. 4,955,153 describes a device which can be utilized on flat or gently curved surfaces wherein an adhesive strip forms the space within which a display is inserted. This device is acceptable for small signs, such as bumper stickers, small placards and the like or with gently curved surfaces. As the size of the sign increases the device is no longer acceptable since the weight is sufficient to cause the device to become dislodged. Also, as the curvature increases the likelihood of becoming dislodged increases. This device is particularly unsatisfactory for use in the interior of a bus where curvature can be quite demanding and the preferred sign size is large, such as 30 to 75 inches across.

The ability to rapidly change signs allows the transportation provider to maximize opportunities for profit from advertisement space. Therefore, the ability to quickly remove, and replace signs is a great benefit. Devices which require the removal of screws, or securing devices are undesirable as are devices which irreversibly alter the interior structure of the vehicle.

Another issue common to display devices is the threat of vandalism such as graffiti. Displays which are not covered are particularly undesirable due to the ease with which they are defaced. Therefore there is a desire to cover displays. Covering a display often contradicts the desire to provide a display which can be rapidly changed.

It has been a long felt desire in the art to have available a display device which can be used with large displays on surfaces with various curvature without risk of becoming dislodged. It has also been a desire to have such a display device which does not require irreversibly altering the interior of the vehicle.

SUMMARY

It is an object of the present invention to provide a display holder which is easily conformed to a curved surface, such as the transition surface of a bus interior, without sacrificing the ability of the display holder to be securely fastened to the surface.

It is another object of the present invention to provide a display holder which allows easy removal and replacement of a display yet covers the display.

It is yet another object of the present invention to provide a display holder which is economical to manufacture, can be installed in the interior of a vehicle with minimal alteration of the vehicle and is securely fastened.

These and other objects, as will be realized from the disclosure herein, are provided in a display holder for attachment to an interior of a vehicle. The display holder is capable of slidably receiving a display. The display holder comprises a rectangular window plate comprising a front edge, rear edge, first side edge and second side edge. A first mounting plate is attached to the first side edge wherein the window plate and the first mounting plate form a first elongated slot there between. A second mounting plate is attached to the second side edge wherein the window plate and the second mounting plate form a second elongated slot there between. An end cap is attached to the interior and overlays the front edge.

Another embodiment is provided in a method for attaching a display holder to a transition surface of a vehicle. The method comprises:

- attaching a flexible holder to the transition surface;
- removing a securing element from a securing void of a roof strip of the transition surface;
- placing an end cap on the roof strip wherein the end cap comprises a void which aligns with the securing void and the end cap overlays the flexible holder; and
- inserting the securing element in the void and the securing void to secure the end cap in fixed relationship with the roof strip thereby securing the flexible holder between the transition surface and the end cap.

Yet another embodiment is provided in a display holder for attachment to a transition surface of a vehicle. The display holder is capable of slidably receiving a display. The display holder further comprises a rectangular window plate comprising a front edge, rear edge, first side edge and second side edge. A mounting plate, comprising an interior tab and an exterior tab is attached to the window plate between the interior tab and the exterior tab forming an elongated slot between the interior tab and the window plate. An end cap is attached to the interior and overlays the front edge

DETAILED DESCRIPTION

The present invention provides a display or sign holder which is particularly adapted for securing to the interior of a vehicle, specifically a bus, and which can easily conform to the contour of the interior with minimal alteration and no requirement to remove parts when the sign is to be changed. The display sign holder will be described with particular reference to the drawings which form a part of this description.

Figure 1:
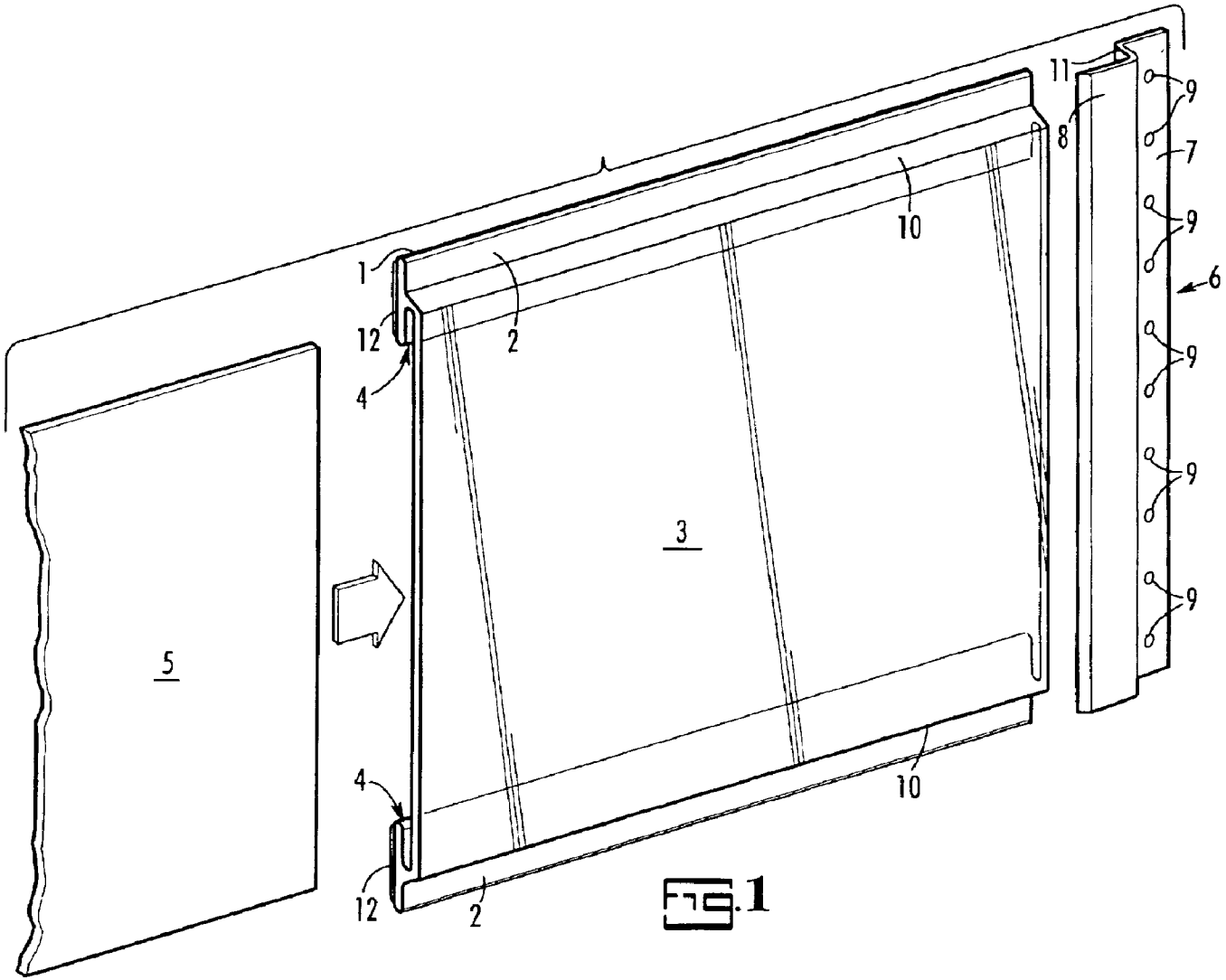
FIG. 1 is a perspective view of the components of an embodiment of the present invention.

A display sign holder is shown in perspective, blown apart view in FIG. 1. In FIG. 1, the display sign holder comprises a flexible holder, 1, which is an extruded element within which the display, 5, is retrievably placed. The flexible holder, 1, comprises a pair of mounting plates, 2, and a window plate, 3. The mounting plates are small in relation to the window plate. The window plate, 3, projects over a portion of the mounting plates thereby forming a pair of parallel elongated slots, 4, between the mounting plates and window plate. The elongated slots, 4, slidably receive the sign, 5, therein. The window plate, 3, and mounting plates, 4, are attached one to the other by a ledge, 10. In a preferred embodiment the mounting plate extends beyond the ledge on either side thereby forming a portion of the elongated slot on one side and a tab on the other side.

Secured to the mounting plates, 2, opposite to the window plate, 3, are adhesive devices, 12. An adhesive device, 12, is an attachment means which secures the mounting plate to a surface. Particularly preferred adhesive devices, when pressed between two elements, secure the two elements one to the other. Adhesive devices include glues, adhesives, tapes, etc. Particularly preferred adhesive devices are chosen from a group consisting of glue and tape. A particularly preferred adhesive device is double sided tape. A particularly preferred double sided tape is 3M Thick Acrylic Foam Double Sided Hi-Tac Tape with UHB additive available from 3M Corporation, Minneapolis, Minn.

One end of the flexible holder, 1, is secured by an end cap, 6. The end cap, 6, is a flexible, preferably clear element which covers the terminal portion of the flexible holder. The end cap, 6, comprises an attachment plate, 7, which is secured to the interior of the vehicle. A holder plate, 8, which may be offset from the attachment plate, 7, by a rise, 11, overlays the flexible holder, 1. The attachment plate, 7, further comprises at least one securing void, 9, which preferably mates with the securing means of a roof strip of a vehicle as will be described further herein. The end cap, 6, is preferably an extruded element with the attachment plate, 7, holder plate, 8 and optional rise, 11, all formed as one integral element.

Figure 2:
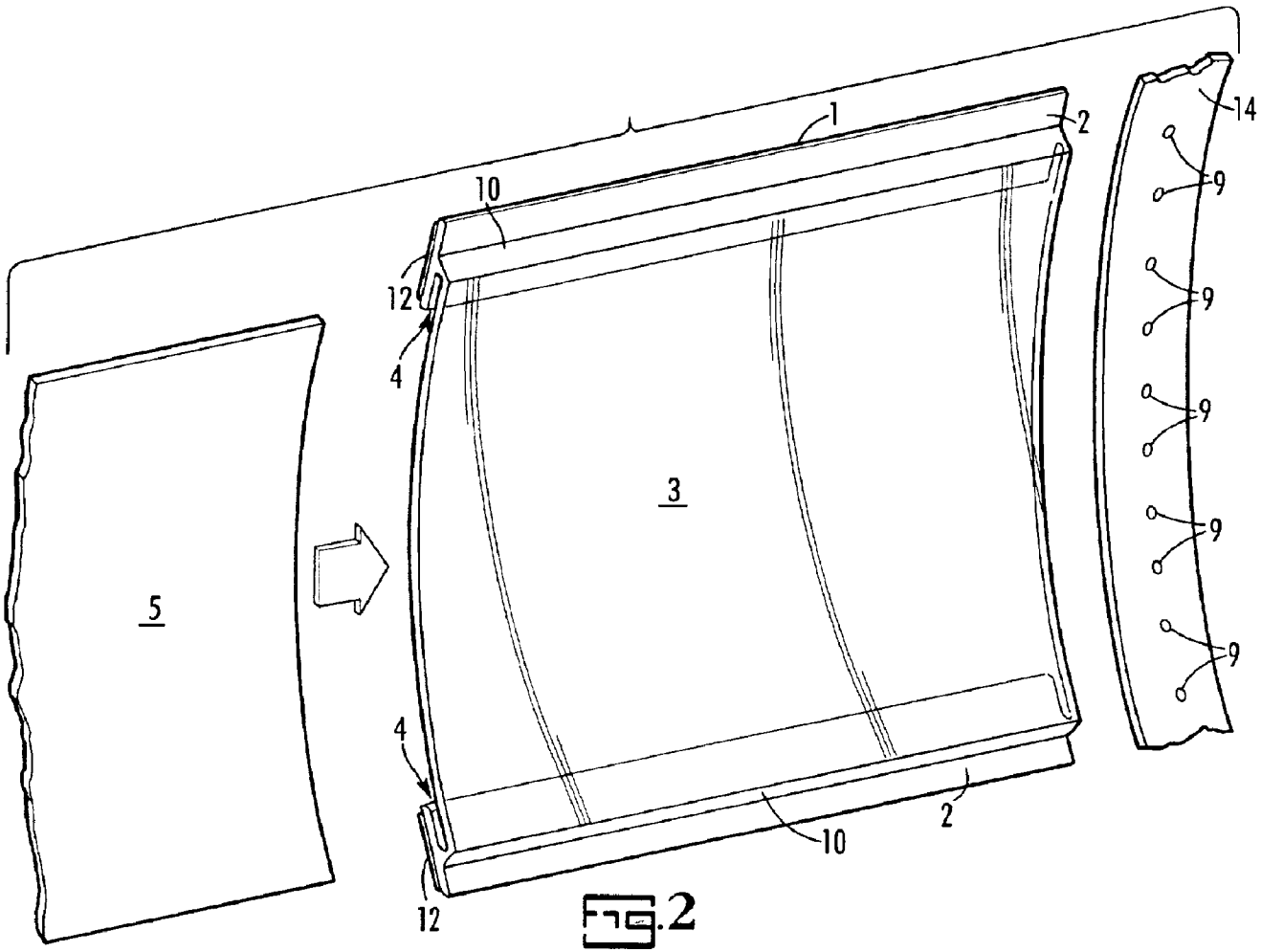
FIG. 2 is a perspective view of the components of another embodiment of the present invention.

An embodiment of the present invention is provided in perspective view in FIG. 2. In FIG. 2, the display holder is shown in a curved orientation as typically employed in a preferred use. The size of the mounting plate, 2, is chosen to insure that there is sufficient area of contact between the adhesive and the surface for adequate adhesion. In the embodiment of FIG. 2, the end cap, 14, is a substantially planar flexible strip with the holder plate and attachment plate being coplanar. The securing voids, 9, are as described relative to FIG. 1. A planar flexible strip is preferred for installation where the roof strip of the vehicle is sufficiently thick to account for the thickness of the flexible holder. The display, 5, is bent to conform to the contour of the flexible holder, 1, and slid into the elongated slots, 4, which are formed between the window plate, 3, and mounting plates, 4. The adhesive, 12, is as described in relation to FIG. 1.

Figure 3:
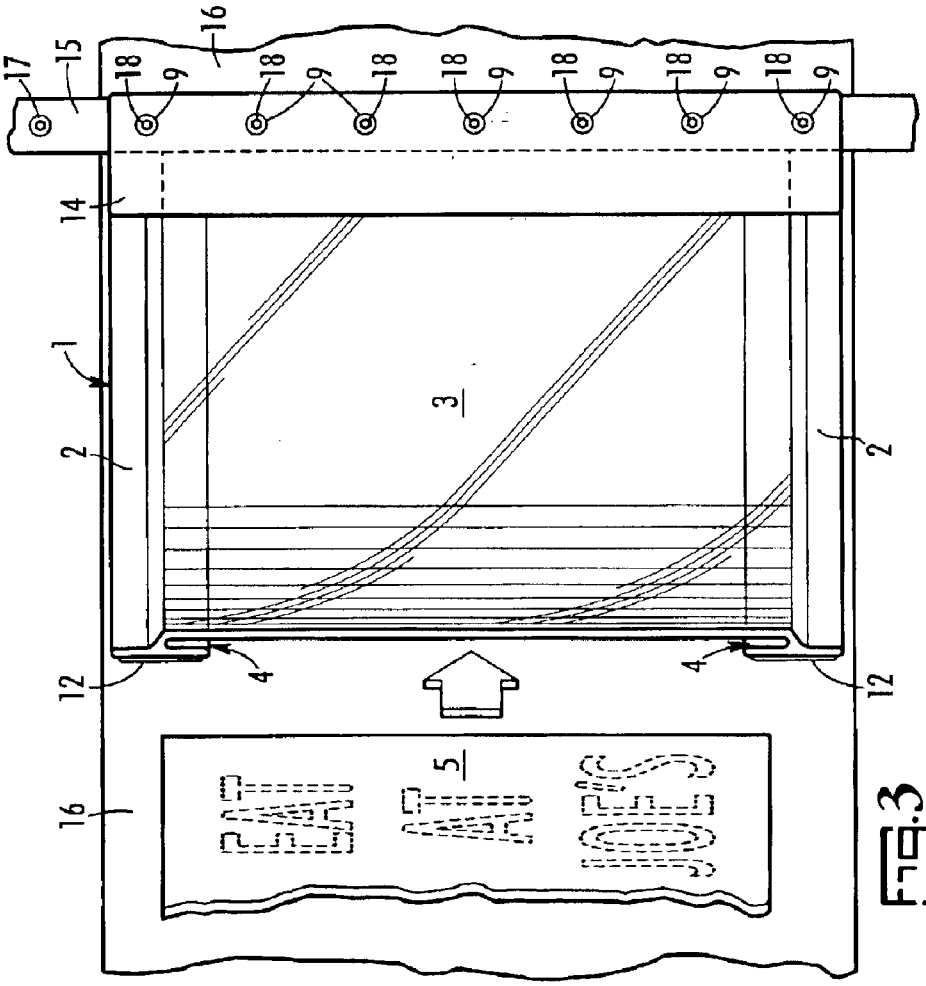
FIG. 3 is a perspective view of an embodiment of the present invention as it would be utilized in the interior of a passenger bus.

A display holder is shown in FIG. 3 as it would be incorporated into the interior of a bus. In FIG. 3, the transition surface, 16, of the bus is shown in partial view. The transition surface is the area between the roof and side wall. The transition surface is preferred since the side wall of most buses is covered by windows and any advertisement on the roof would be difficult to see. The transition surface is typically at about eye level for most passengers and therefore is ideally situated for advertisements. Unfortunately, the transition surface is typically curved since this is the transition from a vertical side wall and substantially horizontal roof.

The display holder is installed by conforming the flexible holder to the curvature of the transition surface, 16, and engaging the adhesive device, 12, with the transition surface to secure the display holder in the preferred position with the proper curvature. The display sign holder is abutted against a roof strip, 15. The securing elements, 17, which align with the securing voids, 9, in the end cap, 14, are removed and the end cap is placed in position such that it overlaps the flexible holder. The securing voids are aligned with the voids in the roof strip. Mounting elements, 18, are then inserted through the end cap, 14, and roof strip, 15, thereby securing the end cap, 14, in position. The mounting elements, 18, and securing elements, 17, may be the same element or the mounting elements may be different to account for length, style or aesthetics.

Figure 4:
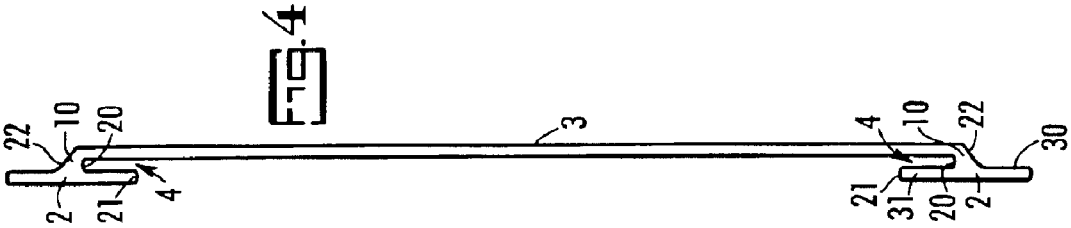
FIG. 4 is a cross-sectional view of a preferred flexible holder.

The flexible holder is shown in cross-section in FIG. 4. The flexible holder, 1, is preferably a single extruded element. The extruded element comprises three parallel planes one of which forms the window plate, 3, and two or which are coplanar parallel planes which are offset to form the mounting plates. The window plate, 3, and mounting plates, 2, are attached by a ledge, 10. The elongated slots, 4, are formed by the separation between the window plate, 3, and mounting plates, 2, and the distance between the window plate and mounting plates is determined by the thickness of the ledge.

Figure 5:
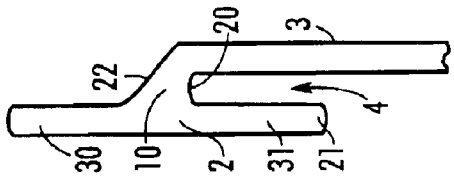
FIG. 5 is a close-up view of a portion of the cross-sectional view indicated in FIG. 4.

A close up view of the terminal portion of the flexible holder indicated in FIG. 4 is shown in FIG. 5. The mounting plate, 2, is secured to the ledge and is preferably integral thereto. The mounting plate preferably extends to either side of the ledge thereby forming an exterior tab, 30, and an interior tab, 31. The interior tab forms one wall of the elongated slot. The exterior tab, 30, provides additional surface area for attachment of the adhesive device. If the exterior tab is not incorporated there is insufficient surface area on the interior tab for attachment of the adhesive device. If the interior tab is increased in size to provide sufficient area it becomes more difficult to slide the display into the elongated slot due to increased friction. Furthermore, if the interior tab is elongated the opening between the interior tab and window plate may decrease as the flexible holder is flexed thereby inhibiting the installation of a display.

Figure 6:
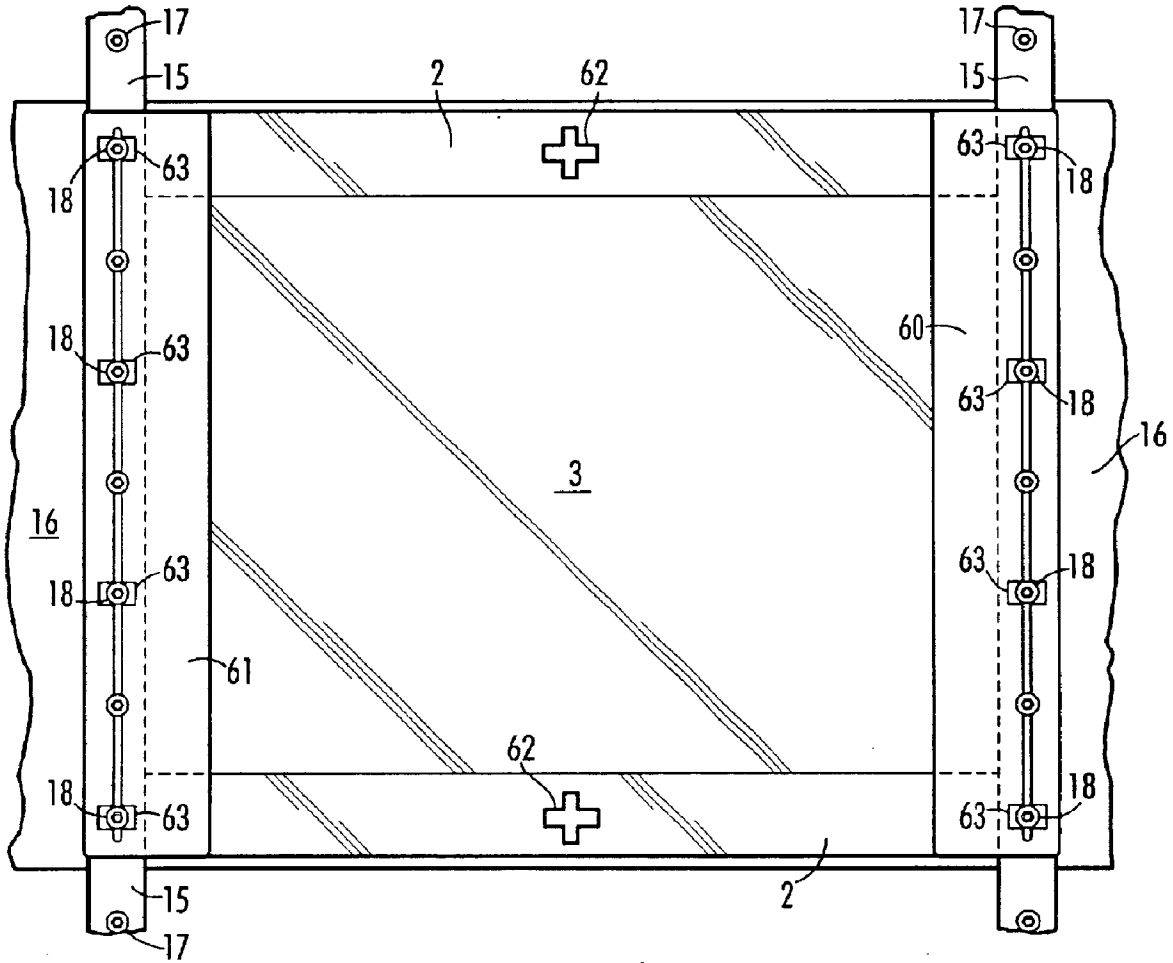
FIG. 6 is a front view of a particularly preferred embodiment of the present invention.

A particularly preferred embodiment is provided in FIG. 6. In FIG. 6, the window plate, 3, has attached thereto a mounting plate, 2, at the each side edge. The mounting plate, 2, has therein a cross slot void, 62, which comprises two slot voids which are taken together to form a cross slot void. The cross slot void is used to secure the flexible holder to a centrally located roof strap by a mounting element. Alternatively, a mounting element for the transition surface panel can be used. The elongated slot voids in two directions allow for flexibility in location of the mounting element relative to the slot voids. The mounting element may not be aligned with the center of the cross slot void but can be offset vertically or horizontally and still be used to secure the flexible holder.

The end caps, 60, comprise slot voids, 63, which receive the mounting elements as described relative to FIG. 3. Slot voids allow for flexibility in mounting location and can provide a means for sliding the end cap over and back thereby allowing a display to be inserted into the elongated slot. In one embodiment the end cap can be temporarily slid to uncover the end of the flexible holder thereby giving access to the elongated slot.

The flexible holder is preferably formed as an extrusion in long sections and cut to the desired length depending on the sign size to be inserted therein. The width of the flexible holder is preferably 6 to 12 inches with 8 to 10 inches being most preferred. The window plate is preferably 5 to 11 inches and more preferably the window is 6 to 8 inches. In a particularly preferred embodiment the distance between the interior surfaces, 20, of the slots is 7 inches. The differences between the interior surface, 21, of the mounting plate, 2, is 6.65 inches in a particularly preferred embodiment. The mounting plate, 2, is preferably approximately 1 to 2 inches in width with approximately 1.4 to 1.75 inches being most preferred. A mounting plate with a width of approximately 1.6 inches is most preferred. The thickness of the window plate and mounting plates are preferably 0.05 to 0.07 inches. The separation between the window plate and mounting plate, which defines the thickness of the elongated slot, is preferably 0.05 to 0.06 inches. The exterior surface, 22, of the ledge, 10, preferably tapers with a particularly preferred exterior surface forming a 45° angle between the surface of the window plate and the exterior surface.

The length of the flexible holder is preferably 30 to 75 inches. More preferably the length is 50 to 60 inches.

The flexible holder and end cap are preferably formed from a clear material which is easily conformed to a contour. Particularly preferred materials of construction include acrylics, such as plexiglass and other clear resins known in the art to be clear and flexible.

The display is typically a rectangular printed media comprising at least one layer of a cellulose based, or plastic based sheet with printing thereon. Multiple layer media may also be used wherein one material, such as a plastic, is coated on a base material, such as a cellulose based product. The material of construction for the display is not limiting.

The invention has been described with particular emphasis directed to the preferred embodiments which are not limiting. Other embodiments and alterations can be realized based on the teachings herein without departing from the scope of the invention which is set forth in the claims which are appended hereto.

What is claimed is:

1. A display holder for attachment to an interior of a vehicle and capable of slidably receiving a display, said display holder comprises:

a rectangular window plate comprising a front edge, rear edge, first side edge and second side edge;

a first mounting plate attached to said first side edge wherein said window plate and said first mounting plate form a first elongated slot there between;

a second mounting plate attached to said second side edge wherein said window plate and said second mounting plate form a second elongated slot there between; and an end cap attached to said interior and overlaying said front edge wherein said interior is a transition surface and wherein said transition surface has a roof strip attached thereto and said end cap is secured to said roof strip.

2. The display holder of claim 1 further comprising a display slidably received in said first elongated slot.

3. The display holder of claim 1 wherein said first mounting plate comprises an interior tab and an exterior tab.

4. The display holder of claim 3 wherein said first elongated slot is between said interior tab and said window plate.

5. The display holder of claim 1 further comprising a ledge between said window plate and said first mounting plate.

6. The display holder of claim 5 wherein said first mounting plate further comprises an interior tab and an exterior tab and said ledge is attached to said first mounting plate between said interior tab and said exterior tab.

7. The display holder of claim 1 wherein said end cap comprises securing voids for receiving an attachment element which secures said end cap to said roof strip.

8. The display holder of claim 1 wherein said end cap comprises an attachment plate and a holder plate.

9. The display holder of claim 1 wherein said first mounting plate further comprises a slot void.

10. The display holder of claim 9 wherein said first mounting plate further comprises a second slot void.

11. The display holder of claim 10 wherein said slot void and said second slot void are overlapping to form a cross slot void.

12. A display holder for attachment to a transition surface of a vehicle and capable of slidably receiving a display, said display holder comprises:

a rectangular window plate comprising a front edge, rear edge, first side edge and second side edge;

a mounting plate comprising an interior tab and an exterior tab wherein said window plate is attached to said mounting plate between said interior tab and said exterior tab forming an elongated slot between said interior tab and said window plate; and an end cap attached to said transition surface and overlaying said front edge wherein said transition surface has a roof strip attached thereto and said end cap is secured to said roof strip.

13. The display holder of claim 12 further comprising a second mounting plate comprising a second interior tab and a second exterior tab wherein said window plate is attached to said second mounting plate between said second interior tab and said second exterior tab forming a second elongated slot between said second interior tab and said window plate.

14. The display holder of claim 12 wherein said first mounting plate further comprises a slot void.

15. The display holder of claim 14 wherein said first mounting plate further comprises a second slot void.

16. The display holder of claim 15 wherein said slot void and said second slot void are overlapping to form a cross slot void.

* * * * *